US006912364B2

(12) United States Patent
Kim

(10) Patent No.: US 6,912,364 B2
(45) Date of Patent: Jun. 28, 2005

(54) CONSUMABLE PRODUCT UNIT, CONSUMABLE PRODUCT REPLACEMENT SENSING SYSTEM AND METHOD THEREOF

(75) Inventor: Min-Seon Kim, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/619,214

(22) Filed: Jul. 15, 2003

(65) Prior Publication Data

US 2004/0013447 A1 Jan. 22, 2004

(30) Foreign Application Priority Data

Jul. 15, 2002 (KR) ..... 2002-0041368
Jun. 30, 2003 (KR) ..... 10-2003-0043998

(51) Int. Cl.[7] ..... G03G 15/00; G03G 21/00

(52) U.S. Cl. ..... 399/12; 399/24; 399/27; 399/112

(58) Field of Search ..... 399/12, 24, 25, 399/27, 110, 111, 112, 119; 347/19, 49, 86

(56) References Cited

U.S. PATENT DOCUMENTS

2002/0003966 A1 * 1/2002 Iwaki et al. ..... 399/12
2002/0164168 A1 * 11/2002 Hayakawa ..... 399/12
2003/0107783 A1 * 6/2003 Mitamura ..... 358/523

FOREIGN PATENT DOCUMENTS

| | | |
|---|---|---|
| JP | 05-061393 | * 3/1993 |
| JP | 05-249777 | * 9/1993 |
| JP | 5-313427 | 11/1993 |
| JP | 08-262832 | * 10/1996 |

* cited by examiner

*Primary Examiner*—Sophia S. Chen
(74) *Attorney, Agent, or Firm*—Staas & Halsey LLP

(57) ABSTRACT

A consumable product unit, a consumable product replacement sensing apparatus and a method thereof are provided. First through third connection terminals of the consumable product unit are respectively and electrically connected to fourth through sixth connection terminals of the consumable product replacement sensing apparatus. A new product determining signal generating unit generates a signal corresponding to an effective resistance value of the consumable product unit connected to the consumable product replacement sensing apparatus through the fourth and fifth connection terminals. If the consumable product unit is new determined to be, an over-current supplying unit supplies an over-current to disconnect a fusible resistor of the consumable product unit and the new product determining signal generating unit generates the signal corresponding to an effective resistance value of one determining element of the consumable product unit. An engine control unit determines whether the consumable product unit is usable.

21 Claims, 3 Drawing Sheets

CONSUMABLE PRODUCT UNIT, CONSUMABLE PRODUCT REPLACEMENT SENSING SYSTEM AND METHOD THEREOF

CROSS-REFERENCE TO RELATED APPLICATIONS

This application claims the benefit of Korean Application No. 2002-41368, filed Jul. 15, 2002 and Korean Application No. 2003-43998, filed Jun. 30, 2003, in the Korean Intellectual Property Office, the disclosures of which are incorporated herein by reference.

BACKGROUND OF THE INVENTION

1. Field of the Invention

The present invention relates to a consumable product unit, a consumable product replacement sensing system and a method thereof, and more particularly, to a consumable product unit, a consumable product replacement sensing system and a method thereof, for recognizing whether or not a new consumable product unit is mounted in a system, as a replacement, and determining whether or not the new consumable product unit is one to use in the system, both of which by using a single circuit.

2. Description of the Related Art

Generally, a photocopier, a printer, a facsimile machine, and a multi-function machine having multi-functions of the photocopier, the printer, and the facsimile machine are types of electrophotograph printing apparatuses. Such a printing apparatus forms an image such that the printing apparatus provides a solid type developer, such as a toner, to a photosensitive medium where an electrostatic latent image forms or the printing apparatus jets a liquid type developer onto the photosensitive medium, and prints an image corresponding to the electrostatic latent image on a paper passing through rollers rotating and in contact with the photosensitive medium.

Consumable products such as a developer or a photosensitive belt of the printing apparatus are consumed or wear out as a result of a continuous use thereof. Accordingly, the consumable products, such as the developer and photosensitive belt are required to be replaced with new ones at proper times. For a replacement of the consumable products, a conventional printing apparatus comprises separate determination circuits to determine whether a newly replaced consumable product is a new consumable product or a used consumable product and to determine whether or not the consumable product is usable in the printing apparatus.

Therefore, the conventional printing apparatus requires an intermediate path circuit having a plurality of ports to connect with the respective determination circuits to an engine control unit. Since the intermediate path circuit is fabricated by an application-specific integrated circuit (ASIC) to have the plurality of ports, a problem of increased fabrication costs exists.

SUMMARY OF THE INVENTION

The present invention solves the above problem in the conventional art. Accordingly, an aspect is to provide a consumable product unit, a consumable product replacement sensing system and a method thereof to determine whether a consumable product unit is mounted in a system, as a replacement, and whether the consumable product unit is usable in the system, both of which are determined by using a single circuit.

Additional aspects and/or advantages of the invention will be set forth in part in the description which follows and, in part, will be obvious from the description, or may be learned by practice of the invention.

The above and/or other aspects are achieved by providing a consumable product replacement sensing system including a consumable product unit to determine whether a consumable product is new and determine a type of the consumable product and a consumable product replacement sensing apparatus, where the consumable product unit is mounted, to determine whether the consumable product is new and to determine the type of the consumable product.

Further, the consumable product unit comprises a first determination element determining whether a replaced consumable product is a new consumable product, a second determination element determining a type of the replaced consumable product, a first connection terminal connected to a first end of the first determination element, a second connection terminal connected to a first end of the second determination element, and a third connection terminal commonly connected to second ends of the first and the second determination elements.

Further, the first determination element is a first fusible resistor having a predetermined first resistance value and melts to disconnect the first and third connection terminals when an over-current is supplied.

Further, the second determination element is a second resistor having a predetermined second resistance value. The second resistance value is higher than the first resistance value and varies according to a manufacturer of the consumable product.

Further, the consumable product replacement sensing apparatus comprises fourth through sixth connection terminals electrically and respectively connected to the first through the third connection terminals, a new product determining signal generating unit generating a level of electrical potential corresponding to at least one of the first and the second determination elements connected to the consumable product replacement sensing apparatus through the fourth and the fifth connection terminals to determine whether the consumable product unit is a new consumable product, an over-current supplying unit intermitting a current-flow path continuing from the fourth connection terminal through the first determination element and the sixth connection terminal by supplying an over-current to disconnect the first determination element, (i.e., disconnect the current-flow path between the first and third connection terminals) and an engine control unit controlling the over-current supplying unit to disconnect the first determination element if the consumable product is determined to be new by the level of electrical potential generated at the new product determining signal generating unit, the engine control unit determining a type of the consumable product by the level of electrical potential corresponding to the second determination element.

The engine control unit may determine that the consumable product is a new consumable product if the level of electrical potential outputted from the new product determining signal generating unit is a first electrical potential level corresponding to the first and the second determination elements, and may determine that the consumable product is a used consumable product if the level of electrical potential outputted from the new product determining signal generating unit is a second electrical potential level corresponding to the second determination element. The first electrical potential level may be lower than a reference level, and the second electrical potential level may exceed the reference value.

Further, the level of electrical potential to determine whether the consumable product unit is new and the level of electrical potential corresponding to the second determination element are inputted from the new product determining signal generating unit to the engine control unit through a shared port.

More specifically, the new product determining signal generating unit comprises a first power source, a third resistor having a first end connected to the first power source and a second end connected to the engine control unit and the fifth connection terminal, and a diode disposed between the fourth and fifth connection terminals to prevent an electric current of the fourth connection terminal from flowing into the fifth connection terminal.

Further, the over-current supplying unit comprises a second power source, and a switching element to connect or to disconnect the second power source to or from the fifth connection terminal according to a control signal of the engine control unit.

The consumable product may be a cartridge containing one or more predetermined color developers, the consumable product unit provided with the consumable product may be a developing device that develops an image by using the one or more color developers supplied from the consumable product, and the consumable product replacement sensing apparatus may be provided in an image forming apparatus that forms the image developed by the developing device on a paper.

Further, the above and/or other aspects are achieved by providing a consumable product replacement sensing method comprising mounting a consumable product unit in a consumable product replacement sensing apparatus, the consumable product unit determining whether a consumable product is a new consumable product and determining a manufacturer of the consumable product, when the consumable product unit is mounted, and determining whether the consumable product is a consumable product to use in the consumable product replacement sensing apparatus.

More specifically, the determining of whether the consumable product is the new consumable product comprises respectively and electrically connecting first through third connection terminals to fourth through sixth connection terminals provided in the consumable product replacement sensing apparatus, wherein the first connection terminal is connected to a first end of a first determination element to determine whether the consumable product is the new consumable product, the second connection terminal is connected to a first end of a second determination element to determine whether the consumable product is usable, and the third connection terminal is commonly connected to second ends of the first and the second determination elements; generating a level of electrical potential corresponding to at least one of the first and second determination elements connected to the consumable product replacement sensing apparatus through the fourth and fifth connection terminals; determining whether the consumable product is the new consumable product by the level of electrical potential; supplying an over-current to the first determination element to disconnect the first determination element when the consumable product is determined to be new; and determining whether the consumable product is usable by the level of electrical potential corresponding to the second determination element. The first through the third connection terminals are provided in the consumable product unit.

The determining of whether the consumable product is the new consumable product determines that the consumable product is the new consumable product if the level of electrical potential is a first electrical potential level corresponding to the first determination element, and determines that the consumable product is a used consumable product if the level of electrical potential is a second electrical potential level corresponding to the second determination element. The first electrical potential level is lower than a reference level.

BRIEF DESCRIPTION OF THE DRAWINGS

These and/or other aspects and advantages of the invention will become apparent and more readily appreciated from the following description of the preferred embodiment, taken in conjunction with the accompanying drawings in which.

DETAILED DESCRIPTION OF THE PREFERRED EMBODIMENT

Figure 1:
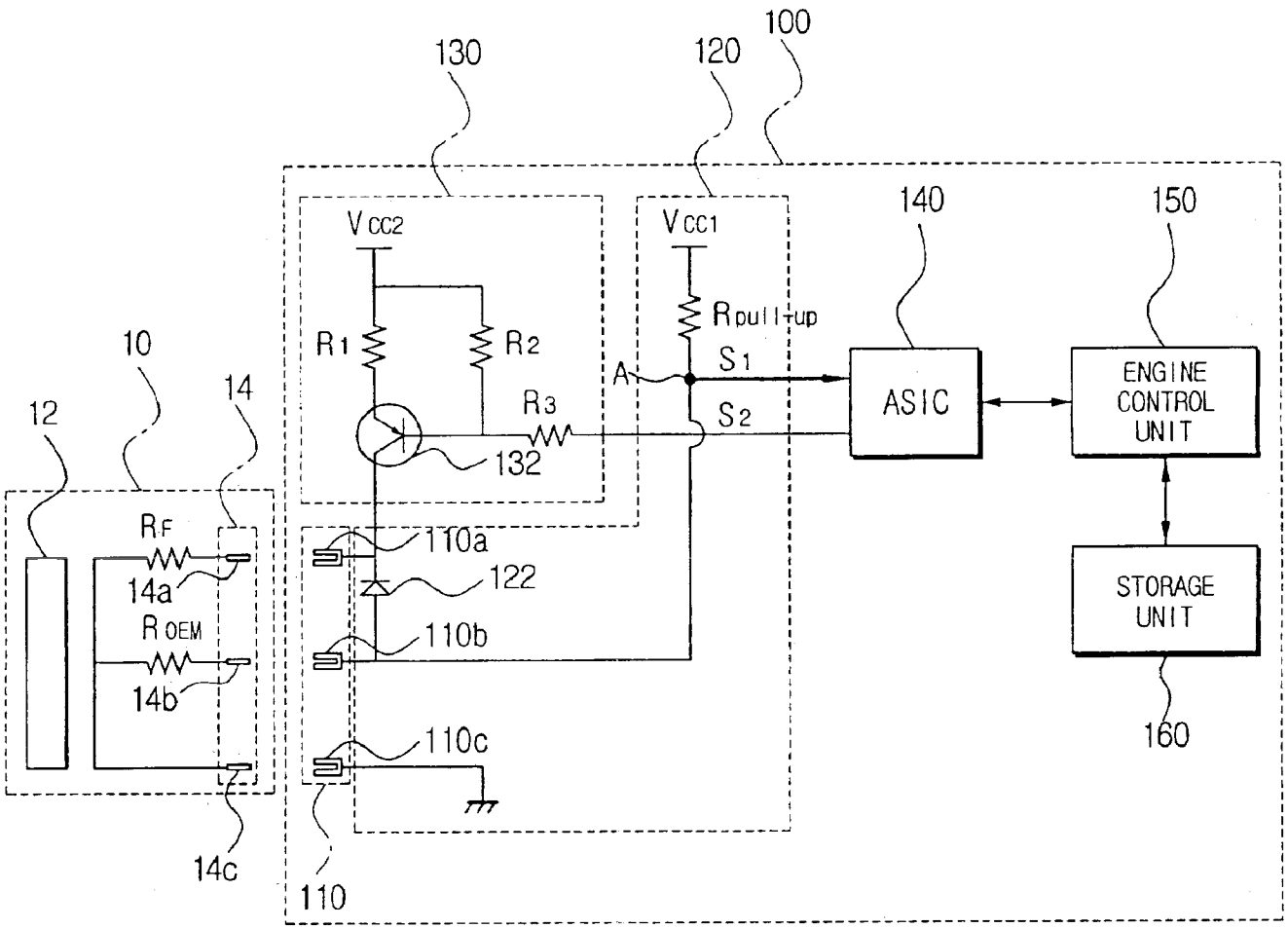
FIG. 1 is a circuit diagram showing a consumable product replacement sensing system according to an embodiment of the present invention.

Reference will now be made in detail to the present preferred embodiment of the present invention, examples of which are illustrated in the accompanying drawings, wherein like reference numerals refer to the like elements throughout. The embodiment is described below in order to explain the present invention by referring to the figures.

FIG. 1 is a circuit diagram showing a consumable product replacement sensing system according to an embodiment of the present invention.

Referring to FIG. 1, a consumable product replacement sensing system comprises a consumable product unit 10 and a consumable product replacement sensing apparatus 100.

The consumable product unit 10 is replaceably mounted on the consumable product replacement sensing apparatus 100 and is replaced with a new consumable product unit when a consumable product 12 provided in the consumable product unit 10 is completely consumed. By way of example, this embodiment uses a cartridge containing one or more color developers as the consumable product 12, and a developing device as the consumable product unit 10, which develops an image by utilizing the one or more color developers supplied from the consumable product 12. The consumable product replacement sensing apparatus 100 determines whether or not the consumable product unit 10 and/or the consumable product 12 are new and usable.

That is, the consumable product 12 is, for example, a toner, ink, a developer or a photosensitive belt, which is consumed as a result of a continuous use thereof, and the consumable product unit 10 is a developing device including a developing roller (not shown) and a developer supplying roller (not shown). The consumable product replacement sensing apparatus 100 is mountable in an image forming apparatus 300 (see FIG. 3) to form an image developed by the consumable product unit 10 on a paper.

The consumable product unit 10 has the consumable product 12, a first determination element $R_F$, a second determination element $R_{OEM}$, and a first connection terminal unit 14.

The consumable product 12, which is a cartridge in this embodiment by way of example, contains a yellow developer, a magenta developer, a cyan developer and a black developer. The consumable product 12 may have additional color developers. If the image forming apparatus 300 (see FIG. 3) employing the consumable product replacement sensing apparatus 100 is only a one-color device (i.e., is mono type), the consumable product 12 may contain only the black developer.

The first determination element RF determines whether or not replacement consumable product unit 10 and/or a replacement consumable product 12 included therewith are new. The first determination element $R_F$ uses a fusible resistor having a predetermined first resistance value (e.g. in a range of about 50 Ω). The fusible resistor melts to disconnect from at least one of first and third connection terminals 14a and 14c when an over-current condition causes an over-current to flow therein.

The second determination element $R_{OEM}$ determines whether or not the consumable product unit 10 and/or the consumable product 12 included therewith are useable in the consumable product replacement sensing apparatus 100. The second determination element $R_{OEM}$ is an OEM resistor to recognize/determine an attachment of an Original Equipment Manufacturer (hereinafter, referred to as "OEM").

The second determination element $R_{OEM}$, which has a second resistance value differing from that of the first resistance value and varies according to a manufacturer and a type of the consumable product 12. Accordingly, the consumable product replacement sensing apparatus 100 determines whether or not the consumable product unit 10 and/or the consumable product 12 included therewith are useable in the consumable product replacement sensing apparatus 100, based on a resistance value of the second determination element $R_{OEM}$. The second resistance value may be in a range of approximately 7 kΩ and varies according to the manufacturer and the type of the consumable product 12.

The consumable product unit 10 is provided with the first connection terminal unit 14 disposed at an end of the consumable product unit 10 to electrically connect the consumable product unit 10 and the consumable product replacement sensing apparatus 100. The first connection terminal unit 14 has a first connection terminal 14*a* connected to a first end of the first determination element $R_F$, a second connection terminal 14*b* connected to a first end of the second determination element $R_{OEM}$ and a third connection terminal 14*c* commonly connected to second ends of the first and second determination elements $R_F$ and $R_{OEM}$.

Further, the consumable product replacement sensing apparatus 100 provided in the image forming apparatus 300 (see FIG. 3) comprises a second connection terminal unit 110, a new product determining signal generating unit 120, an over-current supplying unit 130, an ASIC 140, an engine control unit 150 and a storage unit 160.

The consumable product replacement sensing apparatus 100 determines whether or not the replaced/mounted consumable product unit 10 and/or the replaced/mounted consumable product 12 included therewith are new and determines whether or not the replaced/mounted consumable product unit 10 and/or the replaced mounted consumable product 12 included therewith are useable in the consumable product replacement sensing apparatus 100. Since the determining operations of the consumable product unit 10 are performed in the same manner as that of consumable product 12, hereinafter, descriptions are provided only with regard to the consumable product unit 10 for convenience of explanation, but would additionally apply to the consumable product 10.

The second terminal unit 110 has forth through sixth connection terminals 110*a*, 110*b* and 110*c*. The fourth through the sixth connection terminals 110*a*, 110*b* and 110*c* are respectively and electrically connected with the first through the third connection terminals 14*a*, 14*b* and 14*c*.

The new product determining signal generating unit 120 has a first power source $V_{CC1}$, a pull-up resistor $R_{pull\text{-}up}$ and a diode 122.

The pull-up resistor $R_{pull\text{-}up}$ has a first end serially connected to the first power source $V_{CC1}$ and a second end connected with the ASIC and the fifth connection terminal 110*b*. The diode 122 is disposed between the fourth connection terminal 110*a* and the fifth connection terminal 110*b* to prevent an electric current of the fourth connection terminal 110*a* from flowing to the fifth connection terminal 110*b*.

When the first connection terminal unit 14 of the consumable product unit 10 is connected to the second connection terminal unit 110 of the consumable product replacement sensing apparatus 100 so that the consumable product unit 10 is mounted on the consumable product replacement sensing apparatus 100, the new product determining signal generating unit 120 generates a level of electrical potential S1 that corresponds to an effective resistance value of the consumable product unit 10 connected to the consumable product replacement sensing apparatus 100 through the fourth and the fifth connection terminals 110*a* and 110*b*.

That is, the new product determining signal generating unit 120 generates a level of electrical potential S1 that corresponds to at least one of the first and the second determination elements $R_F$ and $R_{OEM}$. The engine control unit 150 determines whether the consumable product unit 10 and/or the consumable product 12 included therewith are new, based on the level of electrical potential S1.

More specifically, when the consumable product unit 10 is mounted on the consumable product replacement sensing apparatus 100, the first power source $V_{CC1}$ supplies a predetermined electric potential to the pull-up resistor $R_{pull\text{-}up}$. If the consumable product unit 10 is the new consumable product unit, the level of electrical potential S1 at a node A has a 'low' value due to a current path that forms among the pull-up resistor $R_{pull\text{-}up}$, the node A and the sixth connection terminal 110*c*, which is grounded.

That is, if the consumable product unit 10 is the new consumable product unit, the effective resistance value has a parallel composite resistance value of the first and second determination elements $R_F$ and $R_{OEM}$. Accordingly, the effective resistance value provides a lowered electrical potential, and the new product determining signal generating unit 120 generates the 'low' level of electrical potential S1 at node A. The level of electrical potential S1, which corresponds to the first and the second determination elements $R_F$ and $R_{OEM}$, has a low value if the level of electrical potential S1 is lower than a reference level (e.g., in a range of about 2.4 volt).

If the consumable product unit 10 is a used consumable product unit, the first determination element $R_F$ of the fusible resistor melts and is disconnected from at least one of the first and third connection terminals 14*a* and 14*c* to produce an open circuit condition such that the effective resistance value has a resistance value of the second determination element $R_{OEM}$ of an OEM resistor. Thus, the effective resistance value provides an increased electrical potential, and the new product determining signal generating unit 120 generates a level of electrical potential that corresponds to the second determination element $R_{OEM}$. The level of electrical potential S1 at the node A, which corresponds to the second determination element $R_{OEM}$, has a high value, since the level of electrical potential S1 exceeds the reference level.

The over-current supplying unit 130 has a second power source $V_{CC2}$ and a switching element 132. The over-current supplying unit 130 intermits a current-flowing path continuing from the fourth connection terminal 110*a* through the first determination element $R_F$ to the sixth connection terminal 110*c*. Further, the over-current supplying unit 130 supplies an over-current to disconnect the first determination element $R_F$ from at least one of the first and third connection terminals 14*a* and 14*c*.

The second power source $V_{CC2}$ supplies a predetermined electrical potential to a first resistance element R1 serially connected to the second power source $V_{CC2}$ and a second resistance element R2 parallel connected to the first resistance element R1.

The switching element 132 supplies the predetermined voltage supplied from the second power source $V_{CC2}$ to the fourth connection terminal 110*a* or the switching element 132 blocks the predetermined voltage supplied from the second power source $V_{CC2}$ to the fourth connection terminal 110*a* according to a control signal (i.e., a level of electrical potential S2) of the engine control unit 150. The switching element 132 uses a PNP type transistor that performs a switching operation by adjusting an electric current flowing between an emitter terminal of the transistor and a collector terminal of the transistor according to a voltage of a base terminal of the transistor.

The ASIC 140 is an intermediate path circuit to output the level of electrical potential S1 inputted from the node A to the engine control unit 150, and is connected to the new product determining signal generating unit 120 through a single shared port, as shown in a thick solid line in FIG. 1. That is, the ASIC 140 is input with the level of electrical potential S1 from the node A through the single shared port.

The engine control unit 150 determines whether or not the consumable product unit 10 is the new consumable product unit and whether or not the consumable product 10 is useable in the consumable product replacement sensing apparatus 100, based on the level of electric potential S1 generated at the new product determining signal generating unit 120. More specifically, the engine control unit 150 determines that the consumable product unit 10 is the new consumable product unit if the level of electric potential S1 initially generated at the new product determining signal generating unit 120 is a first electrical potential level corresponding to the first and the second determination element $R_F$ and $R_{OEM}$. Also, the engine control unit 150 controls the over-current supplying unit 130 to disconnect the first determination element $R_F$ from, at least one of the first and third connection terminals 14*a* and 14*c*. That is, the engine control unit 150 supplies the switching element 132 with the level of electric potential S2, which is lower than a reference level, and is delivered to the switching element 132 through a third reistance element $R_3$, so that the switching element 132 switches on. When the switching element 132 switches on, the first determination element $R_F$ is disconnected by the over-current.

After the disconnection of the first determination element $R_F$, the engine control unit 150 determines whether or not the consumable product unit 10 is usable in the consumable product replacement sensing apparatus 100 by the level of electric potential S1 subsequently generated at the new product determining signal generating unit 120. Descriptions about this will be made in detail later with reference to FIG. 2.

If the level of electric potential S1 initially generated at the new product determining signal generating unit 120 is a second electric potential level corresponding to the second determination element $R_{OEM}$, the engine control unit 150 determines that the consumable product unit 10, as mounted, is a used consumable product unit.

The first electric potential level is lower than a pre-set reference level, and the second electric potential level exceeds the reference level. The reference levels are pre-set in the storage unit 160 of the consumable product replacement sensing apparatus 100 to determine whether the consumable product unit 10 is the new consumable product unit or the used consumable product unit. In the case that the resistance value of the second determination element $R_{OEM}$ is determined to be within a predetermined range according to the manufacturer, the reference level has a predetermined range according to a predetermined range of the second determination element $R_{OEM}$.

Further, the engine control unit 150 controls general operations of the consumable product replacement sensing apparatus 100 and/or the image forming apparatus 300 (see FIG. 3) using the new consumable product replacement sensing apparatus 100 according to the level of electric potential S1. For example, when the engine control unit 150 determines that the consumable product unit 10 is the used consumable product unit by the second potential level inputted from the ASIC 140, the engine control unit 150 displays a message on a panel (not shown) of the image forming apparatus 300 (see FIG. 3), indicating that the consumable product unit 10 is unusable.

The storage unit 160 stores the reference level to determine whether the consumable product unit 10 is the new consumable product unit or the used consumable product unit and a comparison level of a predetermined range to determine whether or not the consumable product unit 10 is usable in the consumable product replacement sensing apparatus 100.

Operations of the control engine unit 150 will be described in detail with reference to FIG. 2.

Figure 2:
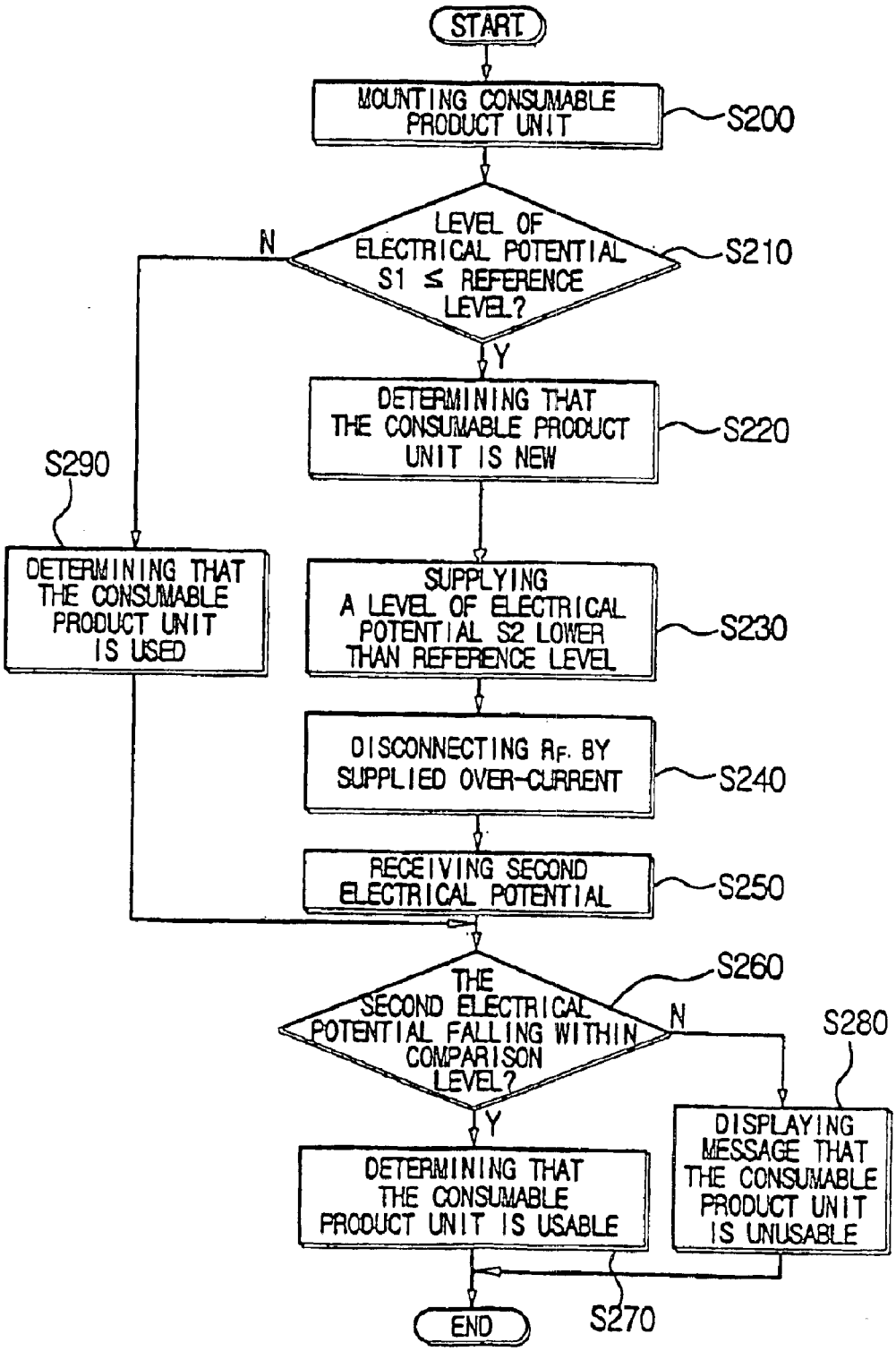
FIG. 2 is a flow chart showing a method of sensing a consumable product replacement according to the apparatus of FIG. 1.

FIG. 2 is a flow chart showing a method of sensing a consumable product replacement.

Referring to FIGS. 1 and 2, the consumable product unit 10 is mounted on the consumable product replacement sensing apparatus 100 used in the image forming apparatus 300 (see FIG. 3) at operation S200. The new product determining signal generating unit 120 generates a level of electrical potential S1 corresponding to the effective resistance value of the consumable product unit 10 (i.e., the first electric potential level).

The engine control unit 150 compares the first electric potential level with the reference level pre-set in the storage unit 160 of the consumable product replacement sensing apparatus 100 at operation S210, and determines that the consumable product unit 10 is the new consumable product unit if the first electric potential level is lower than the pre-set reference level at operation S220.

After the operation of S220, the engine control unit 150 supplies the switching element 132 with the level of electric potential S2 lower than the reference level to supply an over-current to the first determination element $R_F$ at operation S230. The switching element 132 switches on to allow a flow of the over-current to the first determination element $R_F$, which results in a disconnection of the first determination element $R_F$ at operation S240.

After the operation S240, the new product determining signal generating unit 120 outputs a level of electric potential S1 corresponding to the second determination element $R_{OEM}$ (i.e., the second electric potential level ) to the ASIC 140. That is, as the first determination element $R_F$ is disconnected from at least one of the first and third connection terminals 14*a* and 14*c* (i.e., is opened circuited), the effective resistance value of the consumable product unit 10 is determined by only a independent resistance of the second determination element $R_{OEM}$. The ASIC 140 supplies the second electrical potential level to the engine control unit 150. That is, the second electric potential level, corresponding to the second determination element $R_{OEM}$, is inputted to the engine control unit 150 through the node A and the ASIC 140. The second electric potential level corresponding to the second determination element $R_{OEM}$ which has a difference resistance value than that of the first determination element $R_F$, and varies according to a manufacturer and a type of the consumable product unit 10.

After the operation S240, the engine control unit 150 receives the second electric potential level corresponding to the second determination element $R_{OEM}$ from the new product determining signal generating unit 120 at operation S250. Then, the engine control unit 150 reads out the comparison level from the storage unit 160 and compares the second electrical potential level with the comparison level at operation S260. The comparison level has a predetermined range to determine whether or not the consumable product 10 is usable in the consumable product replacement sensing apparatus 100 and has different ranges according to the manufacture and the type of the consumable product unit 10.

In the operation S260, if the second electric potential falls within the range of the comparison level, the engine control unit 150 determines that the consumable product unit 10 is usable in the consumable product replacement sensing apparatus 100 at operation S270. If the second electric potential does not fall within the range of the comparison level in the operations S260, the engine control unit 150 determines that the consumable product unit 10 is not usable in the consumable product replacement sensing apparatus 100. Further, the engine control unit 150 displays a message informing that the consumable product unit 10 is not usable in the consumable product replacement sensing apparatus 100 on the panel of the consumable product replacement sensing apparatus 100. An alarm sound may be used instead of or with the message.

Further, if the level of electric potential SI generated in the operation S220 is higher than the pre-set reference level, the engine control unit 150 determines that the consumable product unit 10 is a used consumable product unit at operation S290. Thus, the level of electrical potential S1 generated in the operation S290 is the second electrical potential level corresponding to the second determination element $R_{OEM}$. Further, the engine control unit 150 subsequently performs the operations S260–S280 again.

If the second electrical potential level is not received in the operation S250, the first determination element $R_F$ is not disconnected from at least one of the first and third connection terminals 14*a* and 14*c*. Accordingly, generating the second electrical potential level is delayed until the first determination element $R_F$ is disconnected from at least one of the first and third connection terminals 14*a* and 14*c*.

The consumable product replacement sensing apparatus 100 as described above is mountable in a system using the consumable product unit 10, for example, in the image forming apparatus 300. The system is not limited to any one apparatus, thus the system may be used in, for example, a printer, a photocopier and a multi-function machine using a toner.

Figure 3:
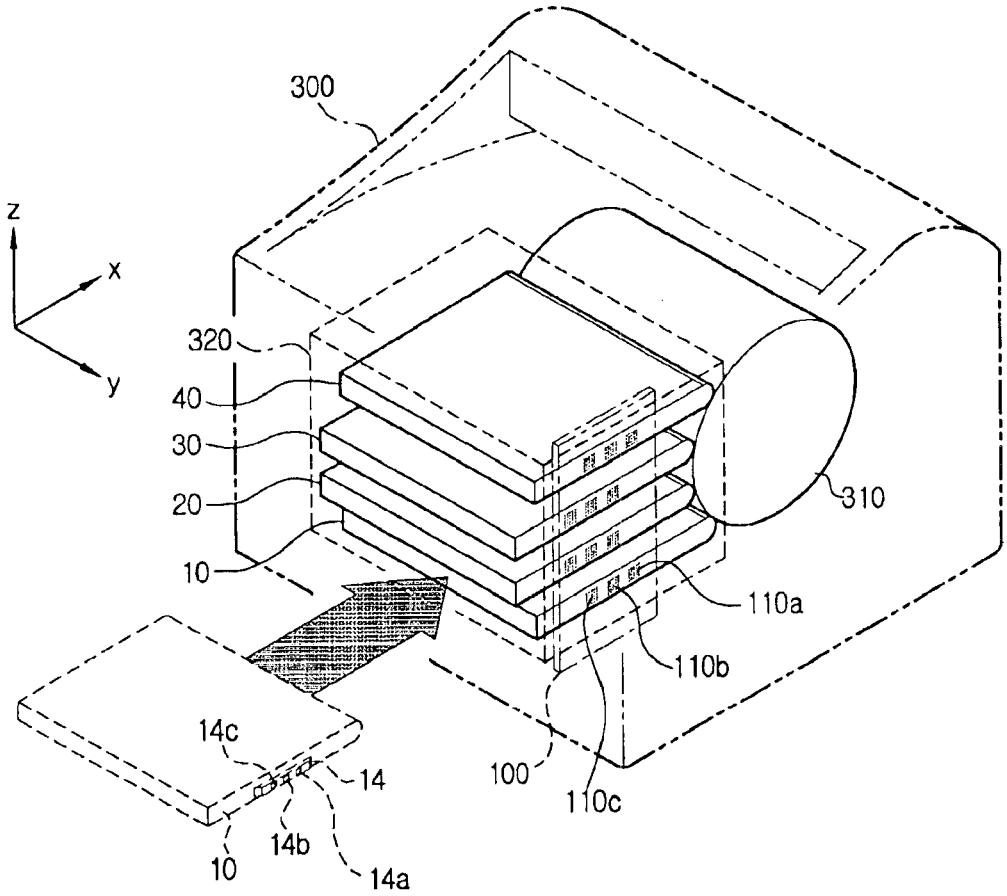
FIG. 3 is a perspective view schematically showing an image forming apparatus having the consumable product replacement sensing system of FIG. 1.

FIG. 3 is a perspective view schematically showing an image forming apparatus which has the consumable product replacement sensing system of FIG. 1.

By way of example, a multi-color printer is used as the image forming apparatus 300. Referring to FIGS. 1 and 3, the image forming apparatus 300 includes a plurality of consumable product units 10, 20, 30 and 40 each containing a different color of developer, a photosensitive drum 310 to transfer the developer formed in a predetermined image on a surface thereof to a printing paper, a mounting portion frame 320 to which the plurality of consumable product units 10, 20, 30 and 40 are removably mounted in a direction of arrow 'x', and a consumable product replacement sensing apparatus 100 to detect whether or not each of the consumable product units 10, 20, 30 and 40 which is electrically connectable with the mounting portion frame 320, is connected, and further, whether or not the consumable product unit 10, 20, 30 and 40 has been replaced.

The plurality of consumable product units 10, 20, 30 and 40 are a part of a developing system to develop an image by using predetermined colors of developers being fed from cartridges. That is, the cartridges are ones of the consumable products 12 each of which containing a predetermined color of a respective developer therein such that the cartridges of the consumable product units 10, 20, 30 and 40 have different colors of the developers, respectively.

The consumable product unit 10, being a first consumable product unit 10, contains black developer, a second consumable product unit 20 contains a cyan developer, a third consumable product unit 30 contains a magenta developer, and a fourth consumable product unit 40 contains a yellow developer.

Because the consumable product units 20, 30 and 40 have an identical structure as that of the first consumable product unit 10, description thereof will be omitted. One difference between the consumable product units 10, 20, 30 and 40 is that each consumable product unit 10, 20, 30 and 40 has a different resistance value at the second determination element $R_{OEM}$ according to a corresponding color thereof. This is because the cartridges of the respective consumable product units 10, 20, 30 and 40 have the different colors of the developers. Accordingly, the consumable produce replacement sensing apparatus 100 determines the color of the developer based on a respective resistance value at the second determination element $R_{OEM}$.

The consumable product unit 10, 20, 30 and 40, the consumable product replacement sensing system and the method thereof, integrate elements to recognize whether the consumable product unit 10 is replaced with the new consumable product unit 10, 20, 30 and 40 and to determine whether the consumable product unit 10, 20, 30 and 40 is the consumable product unit to be used in the system, into a single circuit, thereby reducing a number of ASIC ports and providing a simplified circuit compared to that of the conventional art. Accordingly, a manufacturing cost of the ASIC is reducible.

The foregoing embodiments and/or advantages are merely exemplary and are not to be constructed as limiting the present invention. The present teaching can be readily applied to other types of apparatuses.

Although an embodiment of the present invention has been shown and described, it would be appreciated by those skilled in the art that changes may be made in this embodiment without departing from the principles and sprit of the invention, the scope of which is defined the claims and their equivalents.

What is claimed is:

1. A consumable product unit being removably mounted in an electrophotographic image forming apparatus, comprising:

a consumable product to use in image forming;

a first determination element determining a type of the consumable product; and a second determination element determining whether the consumable product is a new consumable product;

wherein the first determination element has at least one end that is not commonly connected to the second determination element.

2. The consumable product unit of claim 1, wherein the first determination element is a first resistor having a predetermined first resistance value and the second determination element is a second resistor having a predetermined second resistance value, the predetermined first resistance value being higher than the predetermined second resistance value.

3. The consumable product unit of claim 2, wherein the second resistor is a fusible resistor, which melts to disconnect when an over-current is supplied.

4. The consumable product unit of claim 2, wherein the predetermined first resistance value varies according to a manufacturer of the consumable product and/or the type of the consumable product.

5. The consumable product unit of claim 1, wherein the consumable product is a cartridge having one or more predetermined color developers.

6. The consumable product unit of claim 1, further comprising:

a first connection terminal connected to a first end of the first determination element and connectable to an external device;

a second connection terminal connected to a first end of the second determination element and connectable to the external device; and a third connection terminal commonly connected to second ends of the first and second determination elements.

7. A consumable product replacement sensing system employed in an electrophotographic image forming apparatus, comprising:

one or more consumable product units removably mountable in a body of the electrophotographic image forming apparatus, to determine a type of a consumable product used in image forming; and a consumable product replacement sensing apparatus in which the one or more consumable units are mounted, the consumable product replacement sensing apparatus determining the type of the consumable product which is employed in a respective consumable product unit;

wherein each of the consumable product units comprises:

a first determination element determining the type of consumable product, a second determination element determining whether a respective mounted consumable produce is a new consumable product, wherein the first determination element has at least one end that is not commonly connected to the second determination element.

8. The consumable product replacement sensing system of claim 7, wherein the first determination element is a first resistor having a predetermined first resistance value and the second determination element is a second resistor having a predetermined second resistance value, the predetermined first resistance value being higher than the predetermined second resistance value.

9. The consumable product replacement sensing system of claim 8, wherein the second resistor is a fusible resistor which melts to disconnect when an over-current is supplied.

10. The consumable product replacement sensing system of claim 8, wherein the predetermined first resistance value varies according to a manufacturer of the consumable product and/or the type of the consumable product.

11. The consumable product replacement sensing system of claim 7, wherein the consumable product replacement sensing apparatus comprises:

a new product determining signal generating unit generating a level of electrical potential corresponding to at least one of the first and the second determination elements;

an engine control unit determining the type of the consumable product by the level of electrical potential corresponding to the first determination element; and an over-current supplying unit supplying an over-current to disconnect the second determination element.

12. The consumable product replacement sensing system of claim 11, wherein the engine control unit determines that the consumable product is the new consumable product if the level of electrical potential generated at the new product determining signal generating unit is a first electrical potential level which corresponds to the first and second determination elements, and determines that the consumable product is an old consumable product if the level of electrical potential generated at the new product determining signal generating unit is a second electrical potential level which corresponds to the first determination element, wherein, if a respective consumable product is determined to be the new consumable product, the engine control unit controls the over-current supplying unit to disconnect the second determination element of a corresponding and new consumable product unit.

13. The consumable product replacement sensing system of claim 7, wherein each of the consumable product units comprises:

a first connection terminal formed at a first end of the first determination element to be connected to an external device;

a second connection terminal formed at a first end of the second determination element to be connected to the external device; and a third connection terminal commonly connected to second ends of the first and second determination elements.

14. The consumable product replacement sensing system of claim 13, wherein the consumable product replacement sensing apparatus comprises:

fourth through sixth connection terminals electrically and respectively connected to the first through third connection terminals;

a new product determining signal generating unit generating a level of electrical potential corresponding to at least one of the first and the second determination elements connected to the consumable product replacement sensing apparatus through the fourth and fifth connection terminals to determine whether the consumable product is the new consumable product;

an engine control unit determining the type of the consumable product by the level of electrical potential corresponding to the first determination element; and an over-current supplying unit intermitting a current-flow path continuing from the fifth connection terminal through the second determination element to the sixth connection terminal by supplying an over-current to disconnect the first determination element, wherein, if the respective consumable product is determined to be the new consumable product by the level of electrical potential generated at the engine control unit, the engine control unit controls the over-current supplying unit to disconnect the second determination element of a corresponding and new consumable product unit.

15. The consumable product replacement sensing system of claim 7, wherein:

the consumable product comprises a cartridge containing one or more predetermined color developers, the one or more consumable product units each being provided with a respective one of the consumable products comprises a developing device that develops an image by using one or more color developers supplied from the consumable product, and the consumable product replacement sensing apparatus is provided in an image forming apparatus that forms the image developed by the developing device on a paper.

16. The consumable product replacement sensing system of claim 7, wherein the first determination element is a first resistor having a first resistance value, wherein the first resistance value of the first resistor varies according to a color of the consumable product provided in the respective consumable product unit.

17. A consumable product replacement sensing method for a consumable product replacement sensing system to use in an electrophotographic image forming apparatus, the method comprising:

mounting one or more consumable product units in a consumable product replacement sensing apparatus, each of the consumable product units being formed such that a type thereof is determinable through evaluation of a first determination element by the consumable product replacement sensing apparatus; and when each of the consumable product units is mounted, determining whether a respective consumable product is a consumable product usable in the consumable product replacement sensing apparatus through evaluation of a second determination element in the respective consumable product unit;

wherein the first determination element has at least one end that is not commonly connected to the second determination element.

18. The consumable product replacement sensing method of claim 17, wherein the mounting of the one or more consumable product units comprises determining whether the one or more mounted consumable products are one or more new consumable products, respectively, by:

electrically connecting a respective consumable product unit having the first and second determination elements to the image forming apparatus, the second determination element to determine usability of the consumable product and the first determination element to determine whether the consumable product is a new consumable product;

generating a level of electrical potential corresponding to at least one of the first and second determination elements;

determining whether the consumable product is the new consumable product by the level of electrical potential; and when the consumable product is determined to be old, determining by the level of electrical potential corresponding to the second determination element whether the consumable product is usable.

19. The consumable product replacement sensing method of claim 18, wherein:

the determining of whether the consumable product is the new consumable product comprises:

determining the consumable product to be new if the level of electrical potential is a first electrical potential level corresponding to the first and second determination elements, and determining the consumable product to be old it the level of electrical potential is a second electrical potential level corresponding to the second determination element, if the consumable product is determined to be the new consumable product, the determining of whether the consumable product is the new consumable product further comprises:

supplying an over-current to the first determination element to disconnect the first determination element by melting a fusible resistor.

20. The consumable product replacement sensing method of claim 18, further comprising:

varying a resistance value of the second determination element according to one or more of a manufacturer of the consumable product, a type of the consumable product and a color of the consumable product provided in the respective consumable product unit.

21. A sensing system, comprising:

a consumable unit including a plurality of resistive elements, wherein one of the resistive elements has at least one end that is not commonly connected to the remainder of the resistive elements; and a sensing apparatus to recognize the consumable unit comprising:

a signal generating portion to generate a signal corresponding to a parallel composite resistance value of the consumable unit connected to the signal generation portion, a disconnecting portion to selectively and permanently disconnect the one of the resistive elements of the consumable unit, and a controller to control the disconnecting portion to disconnect the one of the resistive elements and to compare a level of the signal that is generated from the signal generating portion, after the one of the resistive elements is disconnected, with predetermined standard levels to determine whether the consumable unit is usable in a system and/or to determine a manufacturer of the consumable unit using the sensing apparatus.

* * * * *

UNITED STATES PATENT AND TRADEMARK OFFICE

CERTIFICATE OF CORRECTION

PATENT NO. : 6,912,364 B2
DATED : June 28, 2005
INVENTOR(S) : Min-seon Kim

It is certified that error appears in the above-identified patent and that said Letters Patent is hereby corrected as shown below:

Column 14,
Line 21, change "old it" to -- old if --.

Signed and Sealed this

Twenty-eighth Day of March, 2006

JON W. DUDAS
*Director of the United States Patent and Trademark Office*